US012768135B2

(12) United States Patent
Shimizu et al.

(10) Patent No.: US 12,768,135 B2
(45) Date of Patent: Oct. 20, 2026

(54) WORKING VEHICLE INCLUDING A CONTROLLER WITH AN INERTIAL SENSOR FOR CONTROLLING HYDRAULIC PUMPS

(71) Applicant: TAKEUCHI MFG. CO., LTD., Nagano (JP)

(72) Inventors: Koichi Shimizu, Nagano (JP); Kengo Kumeuchi, Nagano (JP)

(73) Assignee: TAKEUCHI MFG. CO., LTD., Hanishina-gun (JP)

( * ) Notice: Subject to any disclaimer, the term of this patent is extended or adjusted under 35 U.S.C. 154(b) by 152 days.

(21) Appl. No.: 18/231,821

(22) Filed: Aug. 9, 2023

(65) Prior Publication Data

US 2024/0337091 A1 Oct. 10, 2024

(30) Foreign Application Priority Data

Apr. 7, 2023 (JP) ..... 2023-062544

(51) Int. Cl.
*E02F 9/12* (2006.01)
*E02F 9/22* (2006.01)

(52) U.S. Cl.
CPC ..... *E02F 9/123* (2013.01); *E02F 9/2242* (2013.01); *E02F 9/2292* (2013.01)

(58) Field of Classification Search
CPC ..... E02F 9/00; E02F 3/00
See application file for complete search history.

(56) References Cited

U.S. PATENT DOCUMENTS

| | | | | |
|---|---|---|---|---|
| 2011/0067763 | A1* | 3/2011 | Gehloff | E02F 9/2207 137/14 |
| 2014/0166135 | A1* | 6/2014 | Yamashita | E02F 9/2296 137/565.16 |
| 2020/0263393 | A1* | 8/2020 | Fukuda | E02F 9/2232 |
| 2020/0370279 | A1* | 11/2020 | Kozui | E02F 9/2228 |
| 2021/0087793 | A1* | 3/2021 | Young | E02F 9/2232 |
| 2021/0355657 | A1* | 11/2021 | Hyodo | E02F 9/202 |
| 2022/0098825 | A1* | 3/2022 | Yoshihara | E02F 9/123 |
| 2023/0313488 | A1* | 10/2023 | Yoshimura | E02F 9/2075 701/50 |
| 2024/0011248 | A1* | 1/2024 | Kawamoto | E02F 9/2228 |

(Continued)

FOREIGN PATENT DOCUMENTS

| | | |
|---|---|---|
| JP | 2021-50541 A | 4/2021 |
| JP | 2021-50744 A | 4/2021 |

OTHER PUBLICATIONS

"Slew", Mar. 6, 2023, Merriam-Webster (Year: 2023).*

*Primary Examiner* — Aniss Chad
*Assistant Examiner* — Elizabeth J Slowik
(74) *Attorney, Agent, or Firm* — WHDA, LLP

(57) ABSTRACT

The working vehicle includes a lower body, an upper body, a cab, an operation unit, a travel unit, a controller, an inertial sensor, a slewing unit, and a work unit. The controller controls a first hydraulic pump by comparing an actual traveling-operation speed per unit time in the operation unit operated by an operator with acceleration calculated based on an acceleration signal detected by the inertial sensor, and controls a second hydraulic pump by comparing a slewing-operation speed per unit time in the operation unit with angular acceleration calculated based on an angular velocity signal detected by the inertial sensor.

8 Claims, 6 Drawing Sheets

(56) References Cited

U.S. PATENT DOCUMENTS

| | | | | |
|---|---|---|---|---|
| 2024/0271392 | A1* | 8/2024 | Nishikawara | E02F 9/2235 |
| 2024/0287763 | A1* | 8/2024 | Amano | F15B 11/044 |
| 2024/0328120 | A1* | 10/2024 | Mori | E02F 9/2228 |
| 2025/0012052 | A1* | 1/2025 | Tsukamoto | E02F 9/205 |
| 2025/0297454 | A1* | 9/2025 | Ono | E02F 9/123 |
| 2026/0022533 | A1* | 1/2026 | Shirato | E02F 3/435 |

* cited by examiner

WORKING VEHICLE INCLUDING A CONTROLLER WITH AN INERTIAL SENSOR FOR CONTROLLING HYDRAULIC PUMPS

CROSS-REFERENCE TO RELATED APPLICATION

This application is based upon and claims the benefit of priority of the prior Japanese Patent Application No. P2023-062544, filed on Apr. 7, 2023, and the entire contents of which are incorporated herein by reference.

TECHNICAL FIELD

The present invention relates to a working vehicle.

BACKGROUND ART

Conventionally, a working vehicle having a speed sensor and an inertial sensor is proposed (PTL 1: JP2021-050541A, PTL 2: JP2021-050744A).

SUMMARY OF INVENTION

Technical Problem

According to the conventional working vehicle, a controller controls a hydraulic pump to discharge a flow rate according to an operation amount of an operation unit including a travel pedal, an operating lever, and so on operated by an operator. However, since inertial mass required to actuate a full body or an upper body is large, and a large inertial mass cannot be actuated quickly at the maximum acceleration, the large inertial mass is gradually actuated to achieve acceleration. Thus, surplus hydraulic oil in excess of the required flow rate is returned to a hydraulic oil tank without being used to drive hydraulic actuators such as a hydraulic motor and a hydraulic cylinder. In a case where the large inertial mass, hydraulic oil discharged from the hydraulic pump is required to have a low flow rate and a high pressure. However, some operators may set the operation amount of an operation unit suddenly to the maximum amount because some operators intend to immediately actuate the full body or the upper body. When an operator sets the operation amount of an operation unit suddenly to the maximum amount, hydraulic oil having a high flow rate and a high pressure is discharged from the hydraulic pump, and surplus hydraulic oil in excess of the required flow rate is returned to the hydraulic oil tank, so that the energy is wasted. It causes a waste of either or both the fuel consumption and the electric power consumption.

Solution to Problem

The present invention is made in view of the above-described circumstances. Therefore, an object of the invention is to provide a working vehicle in which a controller controls a flow rate of discharge from a hydraulic pump while comparing between an operation speed of an operator and a reference operation speed to improve either or both the fuel consumption and the electric power consumption.

The present invention has been accomplished under the solutions as disclosed below.

The present invention relates to a working vehicle. The working vehicle comprises a first hydraulic pump, a hydraulic motor for a travel unit driven by pressure oil fed from the first hydraulic pump, a travel unit provided with the hydraulic motor, a second hydraulic pump, a hydraulic motor for a slewing unit driven by pressure oil fed from the second hydraulic pump, a slewing unit provided with the hydraulic motor, a lower body provided with the travel unit, an upper body slewably disposed on the lower body, a work unit attached to the upper body, a cab disposed in the upper body, an operation unit provided in the cab, an inertial sensor provided in the upper body, and a controller. The controller includes the inertial sensor that output an acceleration signal corresponding to travel acceleration of a full body and output an angular velocity signal corresponding to an axis of a swivel center shaft in the slewing unit. The controller performs a control of a first flow rate of the first hydraulic pump by comparing an actual traveling-operation speed per unit time in the operation unit operated by an operator with acceleration calculated based on the acceleration signal. The controller performs a control of a second flow rate of the second hydraulic pump by comparing an actual slewing-operation speed per unit time in the operation unit operated by the operator with angular acceleration calculated based on the angular velocity signal.

According to the configuration, the controller controls a flow rate of discharge from a hydraulic pump while comparing between an operation speed of an operator and a reference operation speed. Therefore, either or both the fuel consumption and the electric power consumption can be improved.

As an example, the controller performs the control of the first hydraulic pump to discharge the first flow rate, and calculates required flow rate for the full body to perform actual traveling-operation based on the acceleration and a reference traveling-operation speed per unit time obtained by backward calculation from the first flow rate. And, the controller calculates in a case where the controller compares the actual traveling-operation speed per the unit time with the reference traveling-operation speed to determine that the actual traveling-operation speed per the unit time is greater than the reference traveling-operation speed. According to the configuration, even when the operator sets an operation amount of the operation unit suddenly to the maximum amount to thereby exceed the reference operation speed, it is possible to easily control the required flow rate to perform traveling-operation.

As an example, the controller performs the control of the second hydraulic pump to discharge the second flow rate, and calculates required flow rate for the upper body to perform actual slewing-operation based on the angular acceleration and a reference slewing-operation speed per unit time obtained by backward calculation from the second flow rate. And, the controller calculates in a case where the controller compares the actual slewing-operation speed per the unit time with the reference traveling-operation speed to determine that the actual traveling-operation speed per the unit time is greater than the reference traveling-operation speed. According to the configuration, even when the operator sets an operation amount of the operation unit suddenly to the maximum amount to thereby exceed the reference operation speed, it is possible to easily control the required flow rate to perform slewing-operation.

As an example, the controller performs the control of the first hydraulic pump to discharge the first flow rate according to the actual traveling-operation speed, in a case where the controller compares the actual traveling-operation speed per the unit time with the reference traveling-operation speed to determine that the actual traveling-operation speed per the unit time is equal to or smaller than the reference traveling-operation speed. As an example, the controller performs the control of the second hydraulic pump to discharge the second flow rate according to the slewing-operation speed, in a case where the controller compares the slewing-operation speed per the unit time with the reference slewing-operation speed to determine that the slewing-operation speed per the unit time is equal to or smaller than the reference slewing-operation speed. According to the configuration, when the operator operates the operation unit at the reference operation speed or lower, the flow rate is controlled in accordance with the operation by the operator, so that the operator can perform the operation as feeling comfortable.

As an example, a drive source of the first hydraulic pump and the second hydraulic pump is an engine. As an example, the first hydraulic pump and the second hydraulic pump are respectively a variable displacement type swashplate pump. As an example, the first hydraulic pump and the second hydraulic pump are respectively a fixed displacement gear pump.

Advantageous Effects of Invention

According to the present invention, the working vehicle can be achieved in which the controller controls of a flow rate of discharge from a hydraulic pump while comparing between an operation speed of an operator and a reference operation speed. Therefore, either or both the fuel consumption and the electric power consumption can be improved.

DESCRIPTION OF EMBODIMENTS

Figure 1:
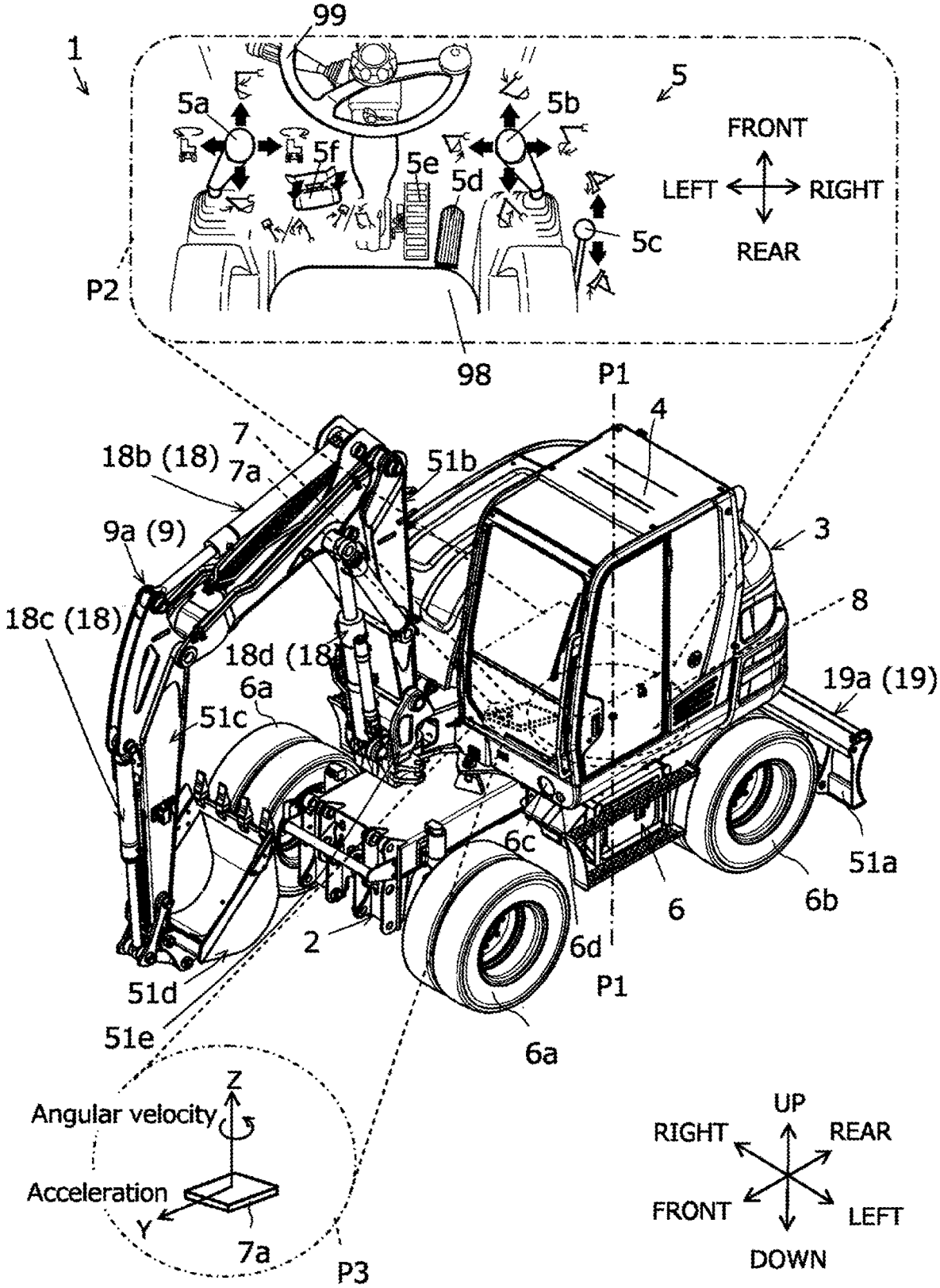
FIG. 1 is a schematic perspective view showing an example of a working vehicle according to an embodiment.

Hereinafter, an embodiment of the invention will be explained in detail with reference to the drawings. FIG. 1 is a schematic view showing an example of a working vehicle 1 according to the embodiment, and is a perspective view from the upper left front. As an example of the working vehicle 1 of the embodiment, a hydraulic excavator is described herein. As a configuration other than the above, the working vehicle 1 may be a track loader or a tracked dumper. The working vehicle 1 includes a travel unit 6 and a slewing unit 8, and an axis P1 of the swivel center shaft in the full body in the horizontal state corresponds to the upward and downward direction, i.e., the Z-axis direction. Incidentally, for the purpose of illustration, up and down, left and right, front and rear directions may be represented by arrows in the diagrams. Further, in the diagrams for use in describing the embodiment, members having the same functions are assigned the respective same reference characters, and the repetitive description thereof may be omitted.

As shown in FIG. 1, the working vehicle 1 includes a lower body 2 that is capable of travelling, an upper body 3 that is provided on the lower body 2 and is capable of slewing, a work unit 9 attached to the upper body 3, and a cab 4 provided on the upper body 3. The cab 4 has an operation unit 5 with which an operator, riding on the vehicle, performs operations for various works including travel and slewing-operations. A part enclosed by a dashed line P2 in the drawing shows a schematic configuration of an arrangement example of the operation unit 5.

The cab 4 has a seat 98 on which the operator rides and sits, a steering wheel 99 operated by the operator, and the operation unit 5 for controlling the operation of the travel unit 6, the slewing unit 8, the work unit 9 (shovel unit 9*a*), a work unit 19 (blade unit 19*a*), and other known work units.

As an example, a left operating lever 5*a* is operated to actuate the slewing unit 8 or an arm 51*c*. As an example, actuating the left operating lever Sa to the left allows the upper body 3 to slew anticlockwise, and the slewing speed thereof is increased or decreased according to the operation amount of the left operating lever 5*a*. As an example, actuating the left operating lever 5*a* to the right allows the upper body 3 to slew clockwise, and the slewing speed thereof is increased or decreased according to the operation amount of the left operating lever 5*a*. As an example, a right operating lever 5*b* is operated to actuate a boom 51*b* or a bucket 51*d*. As an example, a blade lever 5*c* is operated to actuate a blade 51*a*. As an example, a travel pedal 5*d* is operated to actuate the travel unit 6, and the travel speed is increased or decreased according to the operation amount of the travel pedal 5*d*. As an example, a brake pedal 5*e* is operated to stop the travel unit 6. As an example, a boom swing/second boom pedal 5*f* is operated to control the swing direction of the boom 51*b*. It should be noted that the operation unit 5 is not limited to have the configuration described above and the operation unit 5 is appropriately set in accordance with the configuration of the travel unit 6, the slewing unit 8, the work unit 9 (shovel unit 9*a*), the work unit 19 (blade unit 19*a*), and other known work units.

The travel unit 6 of the working vehicle 1 has a four-wheel drive configuration including front wheels 6*a* in which tires are each fitted into an outer periphery of a wheel and back wheels 6*b* in which tires are each fitted into an outer periphery of a wheel. As an example, the upper body 3 of the working vehicle 1 has a pair of left and right headlights 6*c* each of which contains a light source therein to illuminate an area in front of the vehicle, and a pair of winkers 6*d* serving as lighting for indicating the left and right directions. The working vehicle 1 is capable of self-driving on a public road.

The upper body 3 of the working vehicle 1 has a controller 7 and an inertial sensor 7*a*. As an example, the inertial sensor 7*a* is mounted on a control board of the controller 7. As an example, the inertial sensor 7*a* is signal-connected to the controller 7 at a position close to the controller 7 separately. The controller 7 and the inertial sensor 7*a* are each provided in the upper body 3. As an example, the controller 7 and the inertial sensor 7*a* are each provided under the floor of the cab 4. In the present specification, the inertial sensor 7*a* is synonymous with an inertial measurement unit.

As shown in FIG. 1, the inertial sensor 7*a* outputs an angular velocity signal corresponding to an angular velocity around an axis in the Z-axis direction and outputs an acceleration signal corresponding to travel acceleration of the full body. A part enclosed by a dashed line P3 in the drawing shows a schematic configuration which schematically shows the inertial sensor 7*a*. As an example, the inertial sensor 7*a* is a one-chip IC and is a semiconductor package in which a board having a MEMS structure is mounted. As an example, the inertial sensor 7*a* is capable of outputting a signal corresponding to an angular velocity around a front-rear axis, a signal corresponding to an angular velocity around a left-right axis, and a signal corresponding to an angular velocity around an up-down axis, and is capable of outputting a signal corresponding to acceleration in the front-rear direction, a signal corresponding to acceleration in the left-right direction, and a signal corresponding to acceleration in the upward and downward direction. It should be noted that the inertial sensor 7*a* is not limited to have the above configuration and the inertial sensor 7*a* can be a known inertial sensor or inertial measurement unit.

The working vehicle 1 is provided with the work unit 9 (shovel unit 9*a*), the work unit 19 (blade unit 19*a*), and other known work units that are driven by pressure oil. As an example, the shovel unit 9*a* has the boom 51*b*, the arm 51*c*, and the bucket 51*d*. The bucket 51*d* is capable replaced with a known working attachment. The boom 51*b* is attached to the upper body 3 as to swing in the up-down direction and in the up-down direction including the front and rear components. In the embodiment, a boom bracket 51*e* is provided between the upper body 3 and the boom 51*b*. The boom bracket enables the boom 51*b* to swing in the left-right direction and in the left-right direction including the front and rear components with respect to the upper body 3. Incidentally, the boom bracket is sometimes omitted. The arm 51*c* is attached to the boom 51*b* as to swing in the up-down direction and in the up-down direction including the front and rear components. The bucket 51*d* is attached to the arm 51*c* as to swing in the up-down direction and in the up-down direction including the front and rear components.

As an example, the work unit 9 and the work unit 19 are driven by one of a plurality of hydraulic cylinders 18, respectively. The blade unit 19*a* has the blade 51*a*. The blade 51*a* is attached to the lower body 2 as to swing in the up-down direction and in the up-down direction including the front and rear components. The blade 51*a* is configured to swing, by a blade cylinder 18*a*, in the up-down direction with respect to the lower body 2. As an example, the arm 51*c* is configured to swing, by an arm cylinder 18*b*, in the up-down direction with respect to the boom 51*b*. As an example, the bucket 51*d* is configured to swing, by a bucket cylinder 18*c*, in the up-down direction with respect to the arm 51*c*. As an example, the boom 51*b* is configured to swing, by a boom cylinder, in the up-down direction with respect to the upper body 3. As an example, the boom 51*b* is configured to swing, by a swing cylinder, in the left-right direction with respect to the upper body 3 (not shown).

Figure 2:
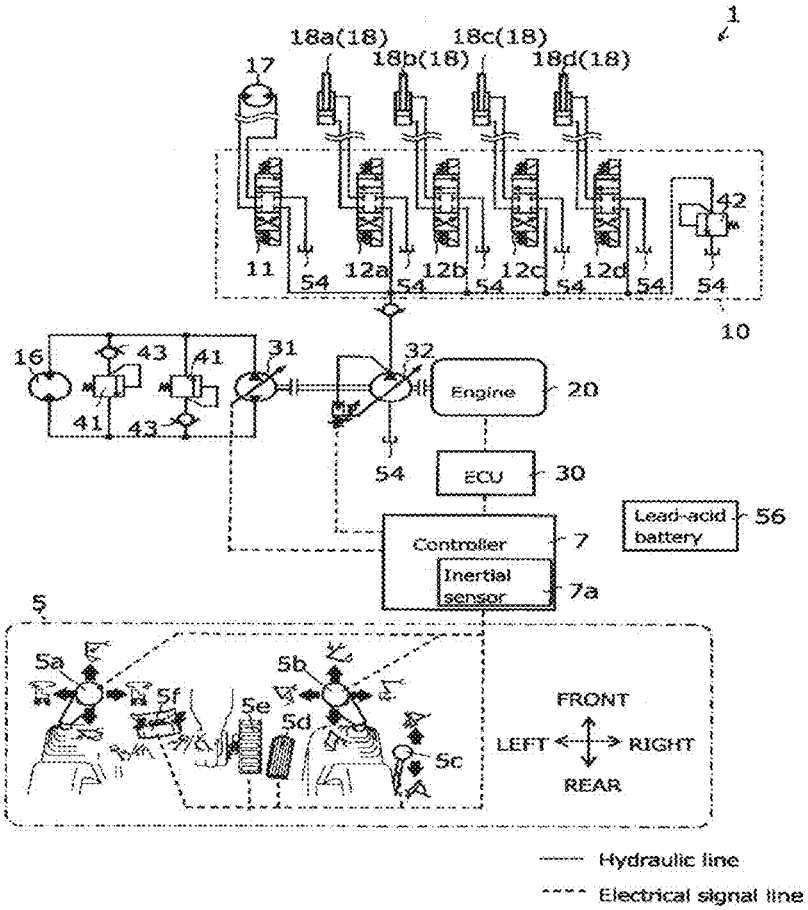
FIG. 2 is a schematic circuit diagram showing an example of a drive control system in the working vehicle shown in FIG. 1.

FIG. 2 is a schematic circuit diagram showing an example of a drive control system in the working vehicle 1. A solid line in the drawing shows a simplified connection for the hydraulic system, and a broken line in the drawing shows a simplified connection for the electric signal system.

The travel unit 6 according to the present embodiment includes a hydrostatic transmission (abbreviated to HST). The drive source of a first hydraulic pump 31 is an engine 20. As an example, the first hydraulic pump 31 is a variable displacement type swashplate pump. A hydraulic motor 16 for the travel unit is coupled to a gear case. Power is transmitted from the gear case to a back wheel axle and the power is further transmitted to the back wheels 6*b* on the left and right, and power is transmitted from the gear case to a front wheel axle through a propeller shaft and the power is further transmitted to the front wheels 6*a* on the left and right (not shown). It should be noted that the above configuration is one example and the travel unit 6 with no HST is used in some cases.

The engine 20 is controlled by an engine control unit 30. The engine control unit 30 is signal-connected to the controller 7. The working vehicle 1 has a lead-acid battery 56 for supplying electric power to the engine control unit 30 and the controller 7 at the time of starting the working vehicle 1.

The working vehicle 1 includes the hydraulic motor 16 for the travel unit, a hydraulic motor 17 for the slewing unit. The working vehicle 1 includes the plurality of hydraulic cylinders 18 (blade cylinder 18*a*, arm cylinder 18*b*, bucket cylinder 18*c*, boom cylinder 18*d*, and other known hydraulic cylinders). The working vehicle 1 also includes a connection port for hydraulically operating the various attachments optionally attached (not shown). Incidentally, FIG. 2 is a schematic configuration diagram, and some notations except for the main parts are omitted in the connections for the hydraulic system and electric signal system.

The working vehicle 1 includes the first hydraulic pump 31 and the hydraulic motor 16 for the travel unit driven by pressure oil from the first hydraulic pump 31. For example, a first check valve 43 is provided on each output side of the first hydraulic pump 31. For example, a first relief valve 41 is provided on an output side of the first check valve 43.

The working vehicle 1 includes a second hydraulic pump 32 and the hydraulic motor 17 driven by pressure oil from the second hydraulic pump 32. For example, the hydraulic motor 17 is connected to a secondary side of a control valve 11.

As an example, the control valve unit 10 has a configuration in which primary sides of a plurality of control valves are connected in parallel. In For example of FIG. 2, primary sides of a control valve 11 for the slew motor, a control valve 12*a* for the hydraulic cylinder, a control valve 12*b* for the hydraulic cylinder, a control valve 12*c* for the hydraulic cylinder, a control valve 12*d* for the hydraulic cylinder, and a second relief valve 42 are connected in parallel, so that a control valve unit 10 is configured. A secondary side of the second relief valve 42 serves as a return passage for the secondary side, and hydraulic oil in excess of a set pressure is returned to a hydraulic oil tank 54. It should be noted that the above configuration is one example. The number of various control valves constituting the control valve unit 10 is sometimes increased and decreased, and the configuration sometimes includes a control valve for a service port as required.

The operation unit 5 is signal-connected to the controller 7. As an example, the operation unit 5 includes the left operating lever 5*a*, the right operating lever 5*b*, the blade lever 5*c*, the travel pedal 5*d*, the brake pedal 5*e*, and the boom swing/second boom pedal 5*f*. The operator operates the operation unit 5 to thereby operate the travel unit 6, the slewing unit 8, the work unit 9, and other known work units. In response to the operation unit 5 operated, an operation signal is output to the controller 7.

Figure 3:
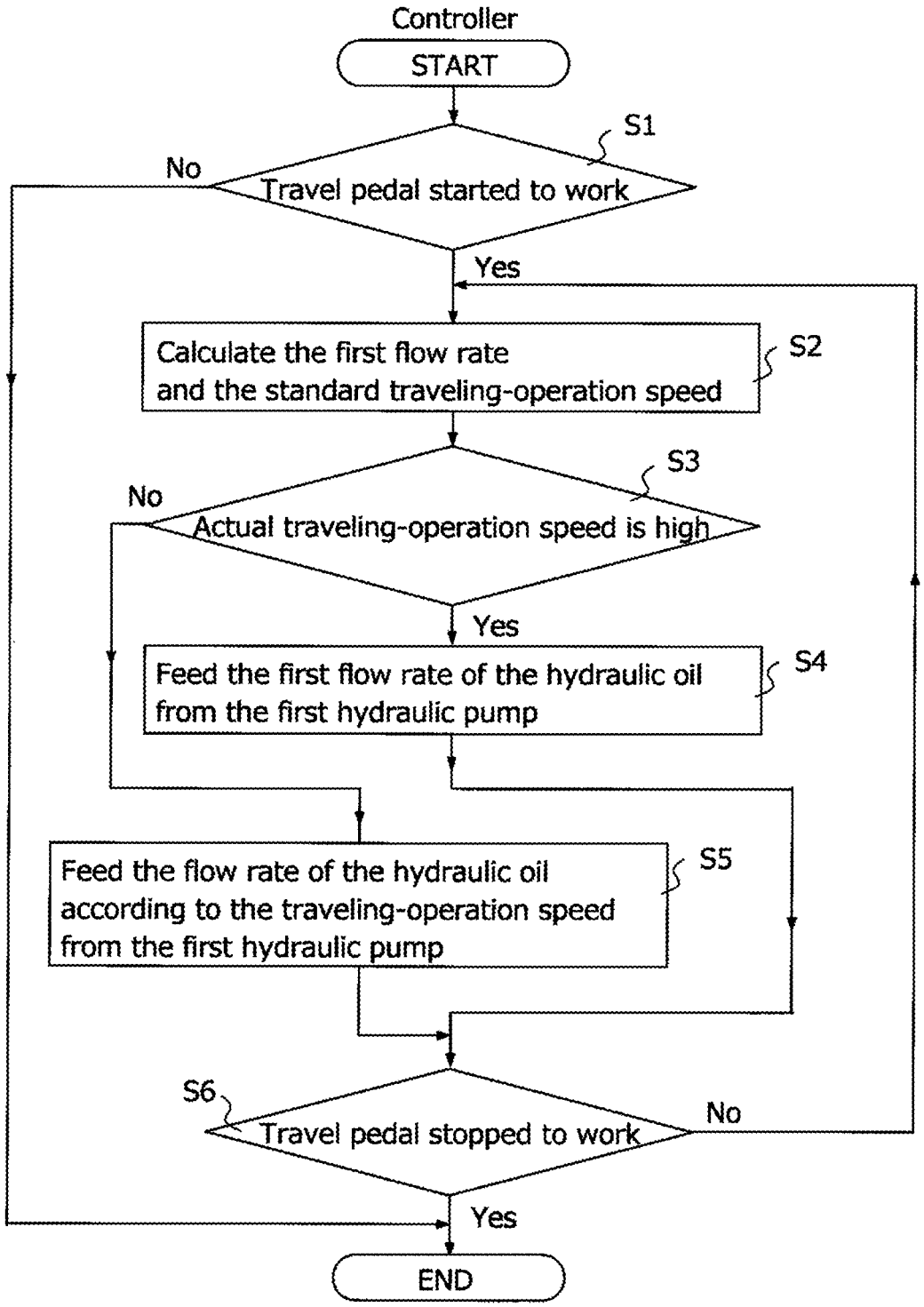
FIG. 3 is a schematic flowchart showing an example of an operation procedure for controlling a flow rate pertaining to traveling-operation in the working vehicle shown in FIG. 1.
Figure 5:
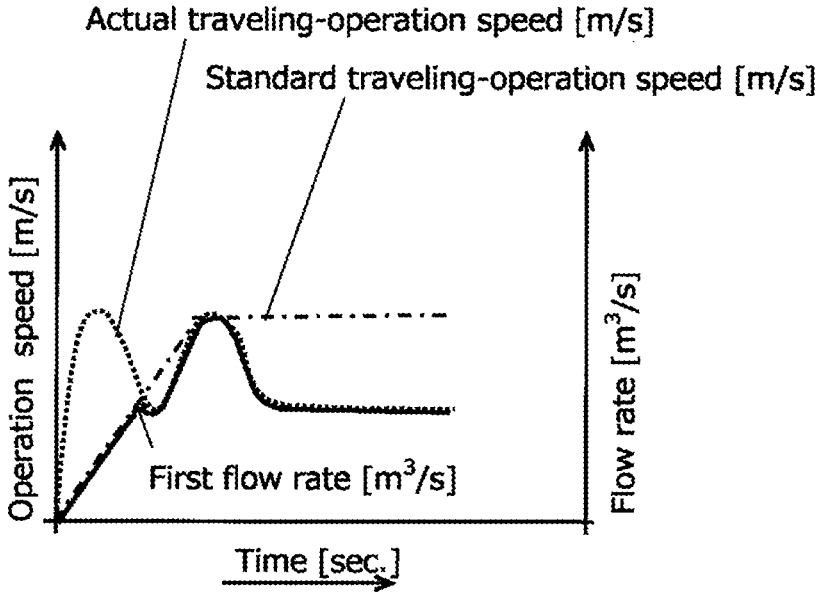
FIG. 5 is a schematic graph showing an example of controlling a flow rate pertaining to the traveling-operation in the working vehicle shown in FIG. 1.

FIG. 3 is a schematic flowchart showing an operation procedure for controlling a flow rate pertaining to traveling-operation. FIG. 5 is a schematic graph showing an example of controlling a flow rate pertaining to the traveling-operation. Next, an example of the control pertaining to the travel unit 6 is described below.

[Example of Control Pertaining to Travel Unit]

In step S1 of FIG. 3, the controller 7 receives a predetermined signal output in response to the operator operating the travel pedal 5*d* and determines whether the travel pedal 5*d* has started to operate. If the controller 7 determines that the travel pedal 5*d* has started to operate, then the processing proceeds to step S2. If the controller 7 does not determine that the travel pedal 5*d* has started to operate, then control of the traveling-operation is not started and the standby state is maintained. And after a predetermined period, the control of the traveling-operation is finished.

In step S2 of FIG. 3, the controller 7 calculates travel acceleration based on an acceleration signal from the inertial sensor 7*a*, calculates a first flow rate required for the full body to perform the traveling-operation based on the calculated travel acceleration, and calculates a reference traveling-operation speed per unit time by backward calculation from the calculated first flow rate. After step S2, the processing proceeds to step S3.

In step S3 of FIG. 3, the controller 7 compares the calculated reference traveling-operation speed with an actual traveling-operation speed based on the operation amount of the travel pedal 5*d*. If the controller 7 determines that the actual traveling-operation speed is greater than the reference traveling-operation speed, then the processing proceeds to step S4. If the controller 7 determines that the actual traveling-operation speed is equal to or smaller than the reference traveling-operation speed, then the processing proceeds to step S5.

After the controller 7 determines that the actual traveling-operation speed is greater than the reference traveling-operation speed and the processing proceeds to step S4, the controller 7 controls the first hydraulic pump 31 to discharge the first flow rate (refer to left side of the graph in FIG. 5). The processing then proceeds to step S6.

After the controller 7 determines that the actual traveling-operation speed is equal to or smaller than the reference traveling-operation speed and the processing proceeds to step S5, the controller 7 controls the first hydraulic pump 31 to discharge a flow rate according to the actual traveling-operation speed (refer to right side of the graph in FIG. 5). The processing then proceeds to step S6.

In step S6 of FIG. 3, when the operator takes foot off the travel pedal 5*d*, the pressure oil is not discharged from the first hydraulic pump 31 and the full body decelerates to stop. If the controller 7 determines that the travel pedal 5*d* stops the operation to return to the initial state, then the controller 7 terminates the control of the traveling-operation. If the controller 7 determines that the travel pedal 5*d* does not return to the initial state and not stop the operation, then the processing returns just before step S2.

According to the embodiment, the controller 7 receives, from the inertial sensor 7*a*, an acceleration signal at the time of the full body travelling, and controls the first hydraulic pump 31 by comparing the operation speed of the travel pedal 5*d* operated by the operator with the reference traveling-operation speed. This improves the fuel consumption or the electric power consumption.

Figure 4:
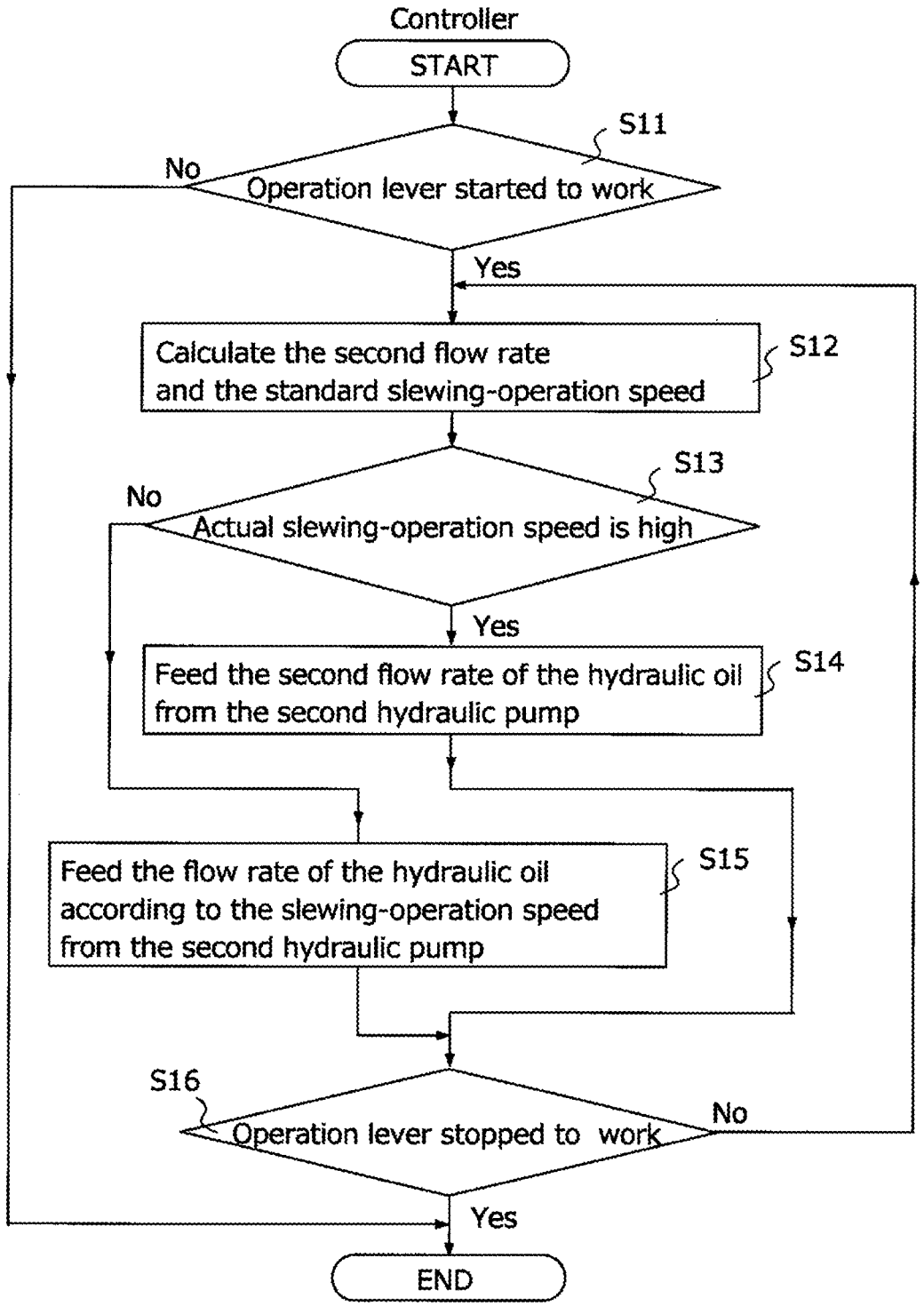
FIG. 4 is a schematic flowchart showing an example of an operation procedure for controlling a flow rate pertaining to slewing-operation in the working vehicle shown in FIG. 1.
Figure 6:
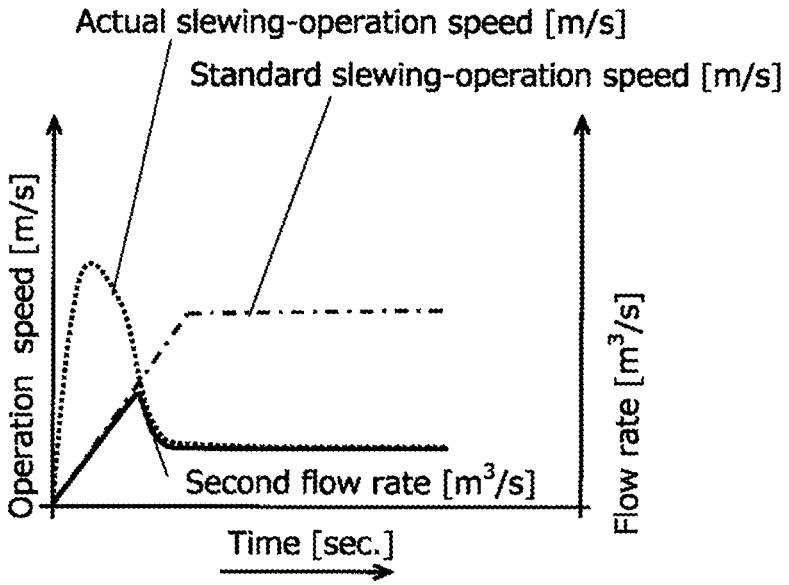
FIG. 6 is a schematic graph showing an example of controlling a flow rate pertaining to the slewing-operation in the working vehicle shown in FIG. 1.

FIG. 4 is a schematic flowchart showing an operation procedure for controlling a flow rate pertaining to slewing-operation. FIG. 6 is a schematic graph showing an example of controlling a flow rate pertaining to the slewing-operation. Next, an example of the control pertaining to the slewing unit 8 is described below.

[Example of Control Pertaining to Slewing Unit]

In step S11 of FIG. 4, the controller 7 receives a predetermined signal output in response to the operator operating the left operating lever 5*a* and determines whether the left operating lever 5*a* has started to operate. If the controller 7 determines that the left operating lever 5*a* has started to operate and the slewing unit 8 slews to the left or slews to the right, then the processing proceeds to step S12. On the other hand, if the controller 7 does not determine that the left operating lever 5*a* has started to operate, then control of the slewing-operation is not started and the standby state is maintained. And after a predetermined period, the control of the slewing-operation is finished.

In step S12 of FIG. 4, the controller 7 calculates angular acceleration based on an angular velocity signal from the inertial sensor 7*a* per unit time, calculates a second flow rate required for the upper body 3 to perform the slewing-operation based on the calculated angular acceleration, and calculates a reference slewing-operation speed per unit time by backward calculation from the calculated second flow rate. After step S12, the processing proceeds to step S13.

In step S13 of FIG. 4, the controller 7 compares the calculated reference slewing-operation speed with a slewing-operation speed based on the operation amount of the left operating lever 5*a*. If the controller 7 determines that the slewing-operation speed is greater than the reference slewing-operation speed, then the processing proceeds to step S14. If the controller 7 determines that the slewing-operation speed is equal to or smaller than the reference slewing-operation speed, then the processing proceeds to step S15.

After the controller 7 determines that the slewing-operation speed is greater than the reference slewing-operation speed and the processing proceeds to step S14, the controller 7 controls the second hydraulic pump 32 to discharge the second flow rate (refer to left side of the graph in FIG. 6). The processing then proceeds to step S16.

After the controller 7 determines that the slewing-operation speed is equal to or smaller than the reference slewing-operation speed and the processing proceeds to step S15, the controller 7 controls the second hydraulic pump 32 to discharge a flow rate according to the slewing-operation speed (refer to right side of the graph in FIG. 6). The processing then proceeds to step S16.

In step S16 of FIG. 4, when the operator takes hand off the left operating lever 5*a*, or, alternatively, when the operator returns the left operating lever 5*a* to the neutral position with hand, the pressure oil is not discharged from the second hydraulic pump 32 and the upper body 3 decelerates to stop. If the controller 7 determines that the left operating lever 5*a* stops the operation to return to the initial state, then the controller 7 terminates the control of the slewing-operation. On the other hand, if the controller 7 determines that the left operating lever 5*a* does not return to the initial state and not stop the operation, then the processing returns just before step S12.

According to the embodiment, the controller 7 receives, from the inertial sensor 7*a*, an angular velocity signal at the time of the upper body 3 slewing, and controls the second hydraulic pump 32 by comparing the operation speed of the left operating lever 5*a* operated by the operator with the reference slewing-operation speed. This improves the fuel consumption or the electric power consumption.

The drive source of the working vehicle 1 is not limited to the above configuration. The drive source of the working vehicle may have a hybrid configuration in which an engine is used along with an electric motor, or may have a configuration in which an electric motor is used. The travel unit 6 is not limited to have the above configuration, and may include a crawler (track). In this way, the working vehicle 1 is sometimes modified appropriately according to the specifications and so on.

What is claimed is:

1. A working vehicle comprising:

a first hydraulic pump;

a hydraulic motor for a traveling-machine driven by pressure oil fed from the first hydraulic pump;

the traveling-machine provided with the hydraulic motor;

a second hydraulic pump;

a hydraulic motor for a slewing-machine driven by pressure oil fed from the second hydraulic pump;

the slewing-machine provided with the hydraulic motor;

a lower body provided with the traveling-machine;

an upper body slewably disposed on the lower body;

a working-machine attached to the upper body;

a cab disposed in the upper body;

an operating-machine provided in the cab;

an inertial sensor provided in the upper body; and a controller, wherein the controller includes the inertial sensor that output an acceleration signal corresponding to travel acceleration of a full body and output an angular velocity signal corresponding to an axis of a swivel center shaft in the slewing-machine, the controller performs a control of a first flow rate of the first hydraulic pump by calculating the travel acceleration based on the acceleration signal, calculating a reference traveling-operation speed based on the calculated travel acceleration, and comparing the calculated reference traveling-operation speed with a traveling-operation speed based on operation of the operating-machine, and the controller performs a control of a second flow rate of the second hydraulic pump by calculating angular acceleration based on the angular velocity signal per unit time, calculating a reference slewing-operation speed based on the calculated angular acceleration, and comparing the calculated reference slewing-operation speed with a slewing-operation speed based on operation of the operating-machine, wherein the controller calculates a first flow rate necessary for the full body to perform actual traveling-operation based on the acceleration, calculates a reference traveling-operation speed per unit time obtained by backward calculation from the first flow rate, and controls the first hydraulic pump to discharge the first flow rate in a case where the controller compares the traveling-operation speed per the unit time with the reference traveling-operation speed to determine that the traveling-operation speed per the unit time is greater than the reference traveling-operation speed, and the controller also calculates a second flow rate necessary for the upper body to perform slewing operation based on the angular acceleration, calculates a reference slewing-operation speed per unit time obtained by backward calculation from the second flow rate, and controls the second hydraulic pump to discharge the second flow rate in a case where the controller compares the slewing-operation speed per the unit time with the reference slewing-operation speed to determine that the slewing-operation speed per the unit time is greater than the reference slewing-operation speed.

2. The working vehicle according to claim 1, wherein the controller performs the control of the first hydraulic pump to discharge the first flow rate according to the actual traveling-operation speed, in a case where the controller compares the actual traveling-operation speed per the unit time with the reference traveling-operation speed to determine that the actual traveling-operation speed per the unit time is equal to or smaller than the reference traveling-operation speed, and the controller performs the control of the second hydraulic pump to discharge the second flow rate according to the slewing-operation speed, in a case where the controller compares the slewing-operation speed per the unit time with the reference slewing-operation speed to determine that the slewing-operation speed per the unit time is equal to or smaller than the reference slewing-operation speed.

3. The working vehicle according to claim 2, wherein a drive source of the first hydraulic pump and the second hydraulic pump is an engine, and the first hydraulic pump and the second hydraulic pump are respectively a variable displacement type swash-plate pump.

4. The working vehicle according to claim 2, wherein a drive source of the first hydraulic pump and the second hydraulic pump is an engine, and the first hydraulic pump and the second hydraulic pump are respectively a fixed displacement gear pump.

5. The working vehicle according to claim 1, wherein a drive source of the first hydraulic pump and the second hydraulic pump is an engine, and the first hydraulic pump and the second hydraulic pump are respectively a variable displacement type swash-plate pump.

6. The working vehicle according to claim 1, wherein a drive source of the first hydraulic pump and the second hydraulic pump is an engine, and the first hydraulic pump and the second hydraulic pump are respectively a variable displacement type swash-plate pump.

7. The working vehicle according to claim 1, wherein a drive source of the first hydraulic pump and the second hydraulic pump is an engine, and the first hydraulic pump and the second hydraulic pump are respectively a fixed displacement gear pump.

8. The working vehicle according to claim 1, wherein a drive source of the first hydraulic pump and the second hydraulic pump is an engine, and the first hydraulic pump and the second hydraulic pump are respectively a fixed displacement gear pump.

* * * * *